US009072329B2

(12) United States Patent
Krauter

(10) Patent No.: US 9,072,329 B2
(45) Date of Patent: Jul. 7, 2015

(54) FASTENING SYSTEM FOR DECORATIVE AND FUNCTIONAL ELEMENTS ON A HELMET

(75) Inventor: Markus Krauter, Rudersberg (DE)

(73) Assignee: CASCO Group Societate in Comandita Simpla (SCS), Satu Mare (RO)

( * ) Notice: Subject to any disclaimer, the term of this patent is extended or adjusted under 35 U.S.C. 154(b) by 100 days.

(21) Appl. No.: 13/539,452

(22) Filed: Jul. 1, 2012

(65) Prior Publication Data

US 2013/0014314 A1 Jan. 17, 2013

(30) Foreign Application Priority Data

Jul. 11, 2011 (DE) ..... 10 2011 051 745

(51) Int. Cl.

| | |
|---|---|
| ***G09F 3/00*** | (2006.01) |
| ***A42B 3/04*** | (2006.01) |
| *F21V 21/08* | (2006.01) |
| *F21V 21/04* | (2006.01) |
| *F21L 14/00* | (2006.01) |

(52) U.S. Cl.

CPC ..... *A42B 3/044* (2013.01); *F21L 15/14* (2013.01); *F21V 21/04* (2013.01); *F21L 14/00* (2013.01); *A42B 3/0406* (2013.01)

(58) Field of Classification Search

CPC ..... F21V 21/04; F21L 15/14; F21L 14/00
USPC ..... 2/209.12, 184.5, 171.1, 209.13, 209.3, 2/171.8, 173.5, 205, 209.4, 175.1, 195.1, 2/171.01; 40/329; 362/105, 106
See application file for complete search history.

(56) References Cited

U.S. PATENT DOCUMENTS

| | | | | |
|---|---|---|---|---|
| 5,327,587 | A * | 7/1994 | Hurwitz | 2/422 |
| 5,357,409 | A * | 10/1994 | Glatt | 362/105 |
| 5,544,027 | A * | 8/1996 | Orsano | 362/105 |
| 5,688,038 | A * | 11/1997 | Chien | 362/103 |
| 5,836,673 | A | 11/1998 | Lo | |
| 6,209,139 | B1 * | 4/2001 | Schmidt et al. | 2/171.1 |
| 7,165,272 | B2 * | 1/2007 | Hudson et al. | 2/209.13 |
| 7,901,104 | B2 * | 3/2011 | McLean et al. | 362/106 |
| 2006/0133068 | A1 | 6/2006 | Sherring | |
| 2008/0201813 | A1 * | 8/2008 | Yang | 2/7 |
| 2010/0177505 | A1 | 7/2010 | Ho | |

FOREIGN PATENT DOCUMENTS

| | | | |
|---|---|---|---|
| DE | 20 2010 011 681 | U1 | 11/2010 |
| DE | 20 2010 010 472 | U1 | 12/2010 |
| DE | 20 2011 004 394 | U1 | 9/2011 |
| EP | 2 071 968 | A2 | 6/2009 |
| GB | 2477009 | A | 7/2011 |

OTHER PUBLICATIONS printout "Helmtarnnetz mit Klammern" www.survival.de catalogue—image of a camouflage net attached to military helmet; such camouflage nets and clip attachments predate the invention.

* cited by examiner

*Primary Examiner* — Syed A Islam
(74) *Attorney, Agent, or Firm* — Gudrun E. Huckett

(57) ABSTRACT

A fastening system is provided that detachably connects two hose-shaped or strip-shaped decorative or functional elements to a helmet. The decorative or functional elements are arranged symmetrically to the centerline of the helmet on the helmet shell so as to extend from the front to the temple area of the wearer to neck area of the wearer. Connecting elements of the fastening are detachably connected to the helmet shell or the helmet. The connecting elements are hooks that are connected fixedly to the decorative or functional element and are hooked in the helmet shell.

12 Claims, 4 Drawing Sheets

FASTENING SYSTEM FOR DECORATIVE AND FUNCTIONAL ELEMENTS ON A HELMET

BACKGROUND OF THE INVENTION

Protective helmets are personal protective gear tested according to the application (for example, type of sport) of the appropriate CE/EN (or corresponding foreign) safety standard. In order to ensure that the protective helmets correspond without limitation to the respectively required safety standards, these helmets may not be altered on one's own account after they have been introduced into the market by the manufacturer.

Foreign components, decals, paint applications—may have a negative effect on the materials and construction and therefore may compromise safety. In order to fulfill the individual wants of users with respect to function and color, helmets are offered in a plurality of—substantially unchangeable—variants. A subsequent adaptation to the individual wants, in particular in respect to color and function, is not provided for.

Since in the last couple of years the want for fashionable appearance even when practicing sports has increased, there is also a significant want to be able to redesign a helmet visually because it is too costly to hold available several helmets for several "outfits".

The current situation is also a problem for the retail market because many different helmet models must be ordered at the beginning of the season in sufficient quantities and lead to full storage facilities. A redesign of the helmets with respect to the currently fashionable color is however not possible so that the order entails a significant risk and moreover incurs significant costs in regard to stock-keeping.

Current helmet models moreover provide no option for a fast and safe attachment of functional elements, for example, insect protection or rain protection above the venting slots.

The object of the present invention resides in that a fastening system for decorative or functional elements for a helmet is to be proposed that enables a simple visual redesign of the helmets in that decorative or functional elements are attached in a simple and detachable way to the helmet.

SUMMARY OF THE INVENTION

The object is solved according to the invention by a fastening system for detachable connection of two hose-shaped or strip-shaped decorative or functional elements to a helmet, wherein the decorative or functional elements are arranged symmetrically to the centerline of the helmet on the helmet shell from the front to the temple area of the wearer to his neck area and, by means of connecting elements, are detachably connected to the helmet shell or the helmet. The object is further solved by a decorative or functional element, and the entity of two decorative or functional elements and a flat element. Preferred embodiments of the invention are the subject matter of dependent claims.

The invention is in principal applicable to all types of protective helmets, but is suitable in particular for sports helmets, such as helmets for skiing, horse-riding, mountaineering and bicycling.

In the following description of the invention, the indication of front and rear always refers to the travel direction. Accordingly, front refers to the area above the face of the wearer and rear to the area of the helmet in the neck area of the wearer.

The fastening system according to the invention for detachable connection of at least one hose-shaped or strip-shaped decorative or functional element on the outer helmet shell of a helmet, wherein the ends of the decorative or functional element(s) are detachably connectable by means of connecting elements with the helmet shell.

In a preferred embodiment of the fastening system, the connecting elements are fastening hooks that are connectable in such a way with the decorative or functional element that this connection can transmit tensile forces. In the simplest case, the fastening hooks comprise a ring that surrounds the decorative or functional element. In another embodiment, the fastening hook has an area that catches on the decorative or functional element upon application of a tensile force and therefore produces a non-positive connection. Moreover, the fastening hook has a hook that is to be hooked in a fastening hole in the helmet shell. Advantageously, the fastening hook is positioned underneath the decorative or functional element so that only the ring that surrounds the decorative or functional element is visible. The end of the decorative or functional element is then inserted also into the fastening hole so that the fastening hook hooked in the fastening hole is no longer visible and therefore does not interfere with the visual appearance.

In a further preferred embodiment, the connecting elements are snap fasteners, clamping elements, hook-and-loop fasteners, or plug elements. In an alternative embodiment, the connecting element is an area of the decorative element or of the helmet shell that is provided with a permanent-elastic adhesive. Suitable for this purpose are, for example, natural rubber adhesives that can be removed without leaving a residue. This type of fastening action is in particular expedient for disposable decorative or functional elements because very inexpensive.

In a further preferred embodiment, the connecting element is a knot of the decorative or functional element that can be hooked into a narrowing hole in the helmet shell. This embodiment is particularly inexpensive.

In a further preferred embodiment, the connecting element is a magnet that is connected to the decorative or functional element and enables a connection to a magnet arranged in or underneath the helmet shell. Advantageously, such a decorative or functional element is attachable particularly quickly and simply. Disadvantageous are the increased production costs.

In an alternative embodiment, the decorative or functional element is guided partially on the helmet shell and partially below the helmet shell. In this way, a functional element can be attached to the helmet with simple means.

In another alternative embodiment, the ends of the decorative or functional element are located on the helmet surface. Preferably, they are held thereat by a cap that is attached to the helmet shell.

It is furthermore preferred that the decorative or functional element is positioned in a recess of the helmet shell. Advantageously, in this way sliding of the decorative or functional element on the helmet shell is prevented.

In a further preferred embodiment, the decorative or functional element is designed to be light-reflecting, phosphorescent or luminescent. In this way, safety can be significantly improved, for example, when used in connection with a bicycle helmet, Furthermore preferred, the decorative or functional element is an LED hose or electroluminescent. Such light sources exhibit only minimal energy demand so that coin cells with small dimensions are sufficient as an energy source. For example, an electroluminescent film can be introduced into the decorative or functional element.

In a preferred embodiment, the decorative or functional element has a battery compartment and on/off switch in the area of its connecting element. Especially preferred, battery and switch are housed in a water-tight housing so that use is possible in the rain.

Further preferred, the decorative or functional element is a flag. This flag is connected across a certain length to the decorative or functional element and projects away from it. This flag can be utilized for advertisement or design purposes. For example, it can also assume an identification function, for example, for dividing the participants of a triathlon into groups.

Particularly preferred, two decorative or functional elements are provided wherein the decorative or functional elements are arranged on both sides, symmetric to the centerline of the helmet (guided from the center of the front end to the center of the rear end of the helmet) on the helmet shell from the forehead to the temple area of the wearer into his neck area. This arrangement is particularly advantageous because, when using a decorative or functional element with a light source or in case of reflecting, electroluminescent or phosphorescent decorative or functional elements, an excellent all-around visibility is ensured which leads to a significantly improved safety in road traffic.

Between the aforementioned two decorative or functional elements, a flat element is arranged according to an alternative embodiment. The flat element can be a rain cover or a net-like element that prevents insects from entering the venting opening. In case the venting openings of the helmet are not arranged between the decorative or functional elements, the flat element may also extend laterally, or to the front or to the rear, across the decorative or functional elements in order to cover venting openings provided there. The projecting portions of the flat element can then be attached additionally with a fastening element, for example, a snap fastener.

The flat element can also have an identification function, for example, an identification of rescue personnel that is recognizable from the air. Also, the flat element can be used very well as an advertising surface. Alternatively, the flat element can also be embodied with camouflage colors or as camouflage net (optionally with introduced camouflage material such as artificial leaves or the like). For this purpose, it is advantageous when the flat element, as described above, extends across the decorative or functional elements and covers an area of the helmet shell that is as large as possible. This embodiment is of interest for the mounted police or rescue personnel.

In this context, the flat elements can have different functional features, for example, watertight, breathable, fire-resistant and heat-resistant, etc.

The hose-shaped or strip-shaped decorative or functional element according to the invention for use with the afore described fastening system comprises a connecting element for connecting to a helmet shell.

BRIEF DESCRIPTION OF THE DRAWINGS

Embodiments of the invention will be explained in the following with the aid of Figures. It is shown in.

DESCRIPTION OF PREFERRED EMBODIMENTS

Figure 1:
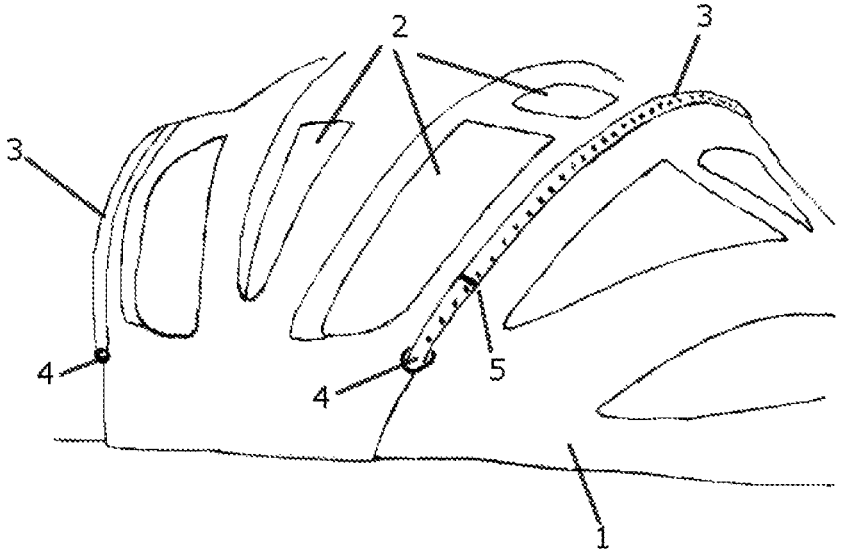
FIG. 1 a front view of a helmet with a decorative element.

FIG. 1 shows a helmet with a helmet shell 1 that is penetrated by venting openings 2. On the helmet shell 1 a decorative element 3, here embodied as a colored rope, is arranged that ends in a fastening hole 4 provided in the helmet shell 1. For attachment, the decorative element 3 is also anchored by means of a fastening hook 5 in the fastening hole 4.

Figure 2:
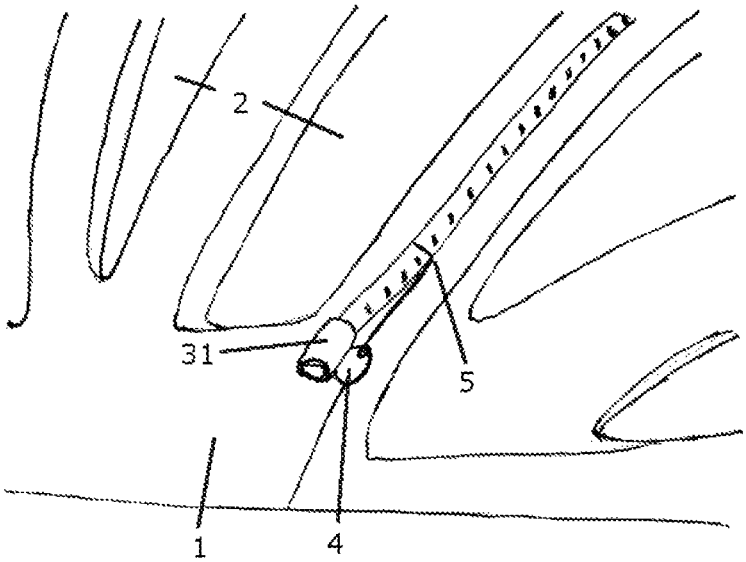
FIG. 2 a front view of a helmet with a decorative element during attachment.

FIG. 2 shows the helmet of FIG. 1 during attachment of the decorative element 3. For this purpose, the fastening hook 5 that is connected with the decorative element 3 is hooked into the fastening hole 4. The end of the decorative element 3 is provided with a sheath 31 that facilitates the introduction of the decorative element 3 into the fastening hole 4 and prevents it from sliding out.

Figure 3:
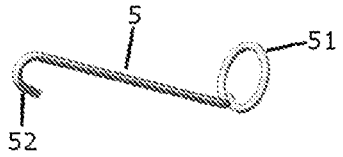
FIG. 3 a fastening hook as a connecting element.

FIG. 3 shows a fastening hook 5 as a connecting element. It comprises a ring 51 that surrounds the decorative element 3 and fixedly connects the fastening hook 5 therewith. For attachment, the ring is pushed onto the decorative or functional element and is secured thereat by compression of the ring 51. The ring 51 of the fastening hook 5 has a diameter of 3.5 mm wherein the fastening hook 5 itself is made of steel wire having a diameter of 0.5 mm. On the other end the fastening hook has an extension with hook 52 for hooking in the fastening hole of a helmet shell.

Figure 4:
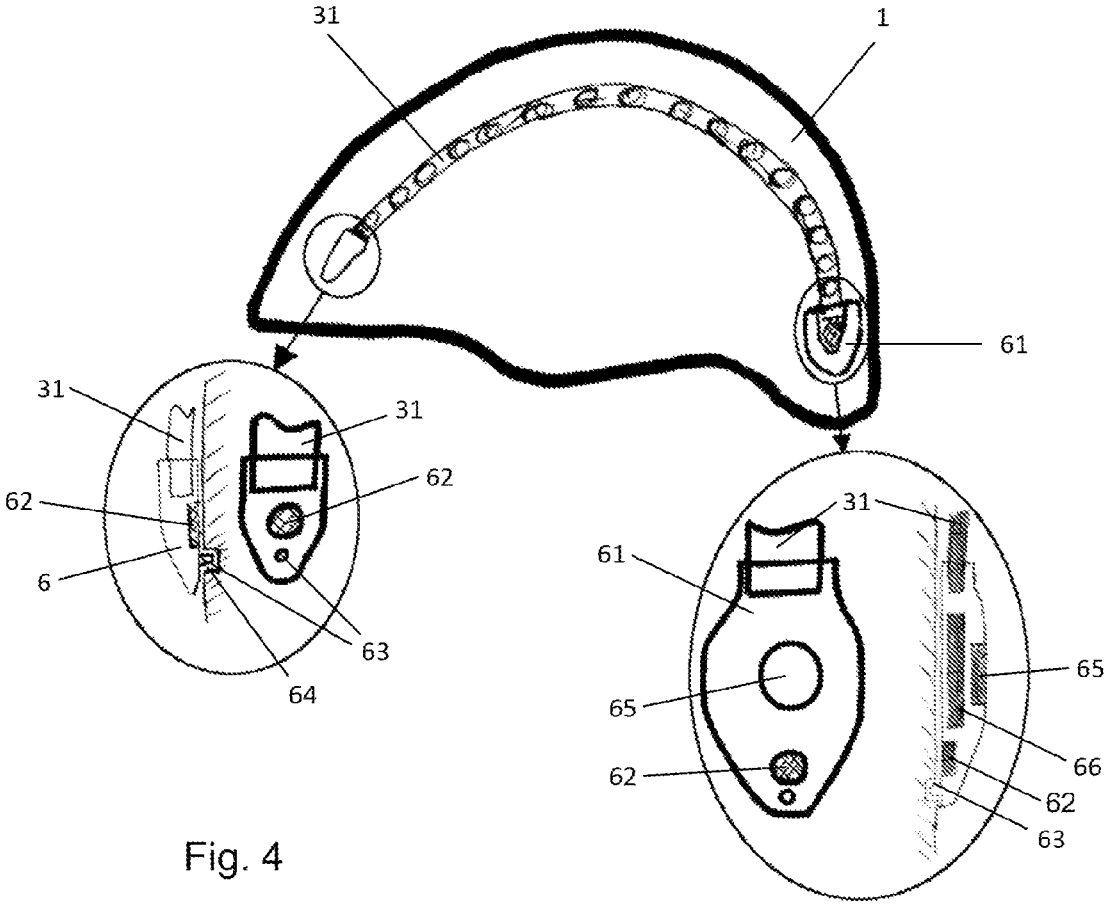
FIG. 4 a helmet with an LED hose as a functional element.

FIG. 4 shows the embodiment with an LED hose 31 as a functional element. The LED hose is provided at its two ends with terminal elements 6 and 61 wherein a terminal element 61 comprises an on/off switch and a battery. Moreover, the terminal elements 6, 61 are anchored by means of magnets in the helmet shell 1. For this purpose, in the terminal elements 6, 61 a magnet 62 is arranged which corresponds to a magnet, not shown here, arranged in or underneath the helmet shell 1. For positional fixation of the terminal elements, the latter have moreover a pin 63 which engages a recess 64 in the helmet shell 1. In this way, the terminal elements 6, 61 cannot slide about the helmet shell.

Figure 5:
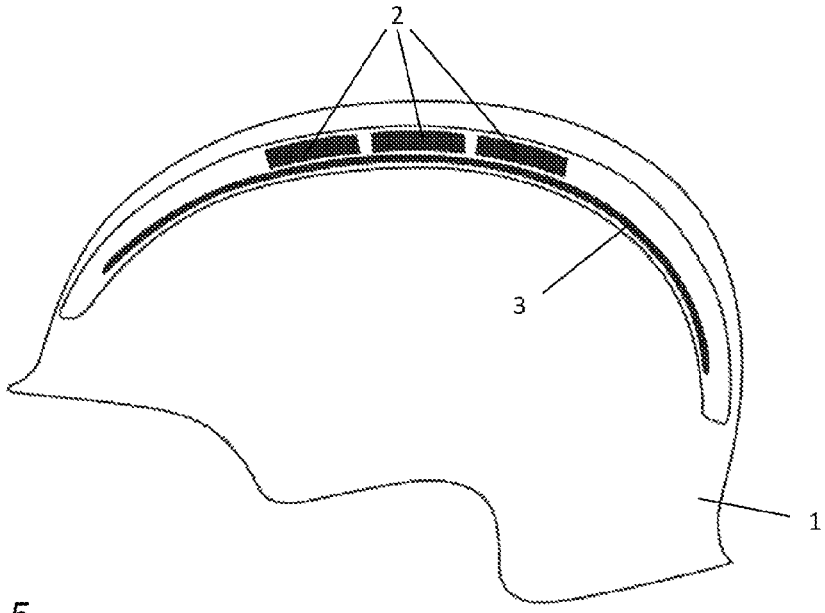
FIG. 5 a side view of a helmet with decorative element.

FIG. 5 shows the side view of a helmet with a decorative element 3 on each helmet side and venting openings 2 arranged in between.

Figure 6:
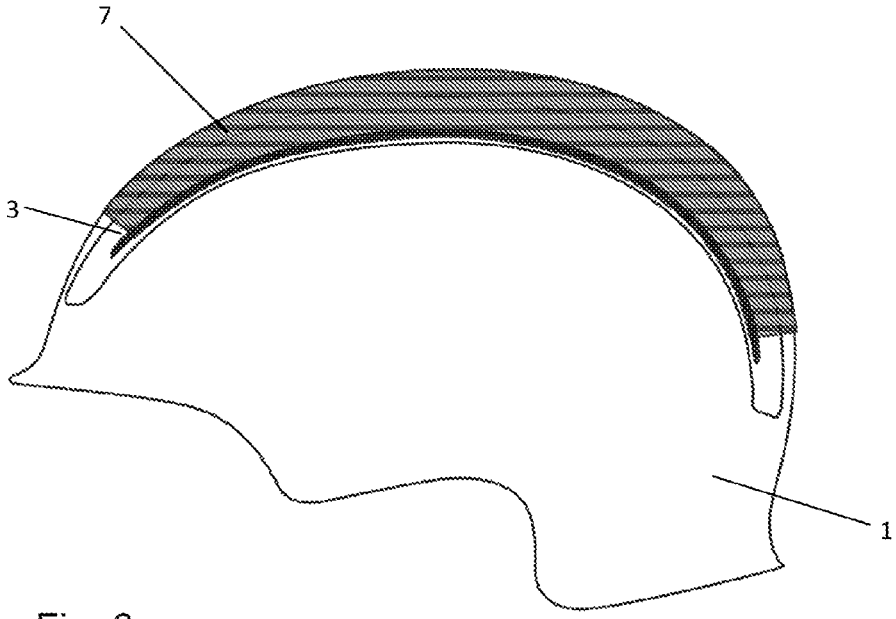
FIG. 6 a side view of a helmet with decorative element and rain cover as a flat element.

FIG. 6 shows the helmet according to FIG. 5 with a rain cover 7 as a flat element. The rain cover 7 is attached to the two decorative elements 3 and prevents penetration of water into the venting openings 2.

Figure 7:
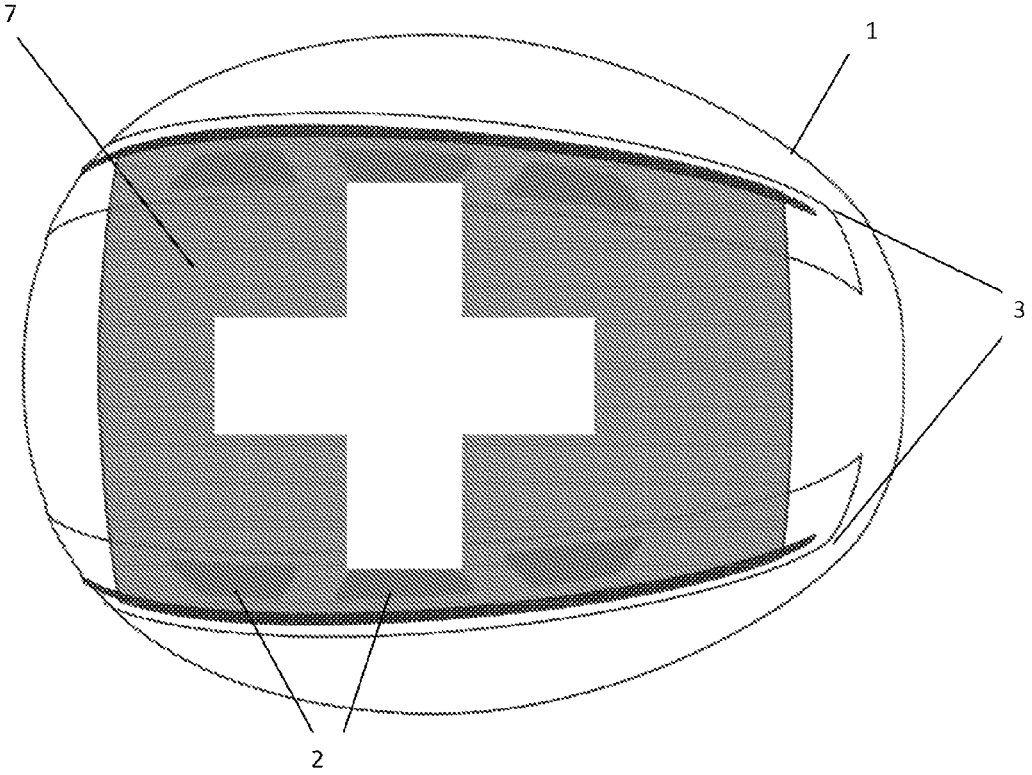
FIG. 7 a plan view of a helmet with flat element.

FIG. 7 shows a helmet with a rain cover 7 as a flat element. The rain cover 7 has moreover a print showing a red cross so that rescue personnel can be more easily seen from the air.

Figure 8:
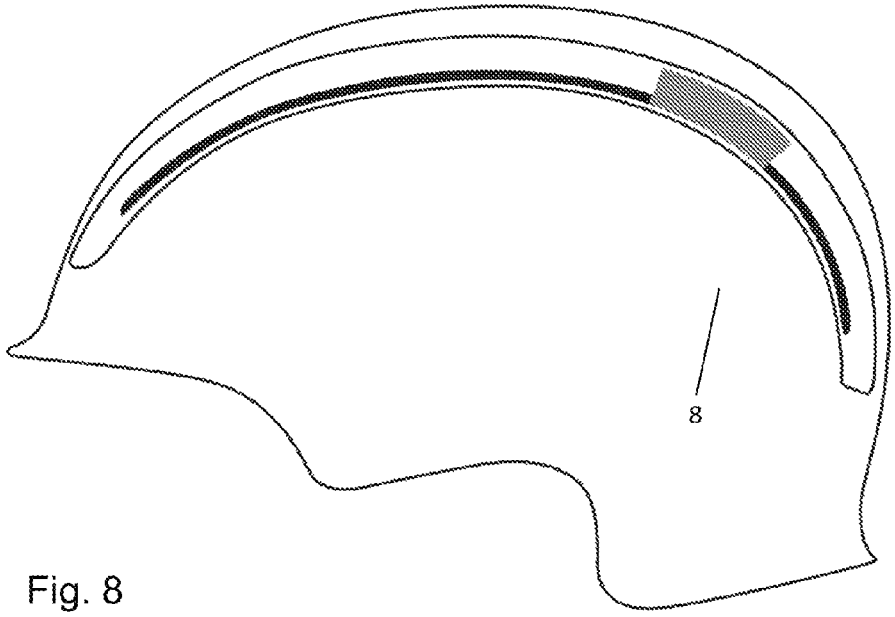
FIG. 8 a side view of a helmet with the flag.

FIG. 8 shows a decorative element with a flag 8. The flag can be used for advertising purposes but also as a design element. The flag 8 is comprised of textile material and surrounds the decorative element 3 and projects from it.

LIST OF REFERENCE NUMERALS

1 helmet shell
2 venting opening
3 decorative or functional element
31 sheath
31 LED hose
4 fastening hole
5 fastening hook
51 ring
52 hook

6 terminal element
61 terminal element with switch and battery
62 magnet
63 pin
64 recess
65 on/off switch
66 battery
7 rain cover

What is claimed is:

1. Fastening system for detachable connection of two hose-shaped or strip-shaped decorative or functional elements to a helmet, wherein the decorative or functional elements are arranged symmetrically to the centerline of the helmet on the helmet shell so as to extend from the front to the temple area of the wearer to his neck area and, by connecting elements, are detachably and exchangeably connected to the helmet shell to customize the helmet according to individual wants of the user by exchanging the decorative and functional elements, wherein the connecting elements are selected from the group consisting of hooks and of knots of the decorative or functional elements, wherein the hooks are connected fixedly to the decorative or functional element, wherein the hooks are hooked in a fastening hole in the form of a cutout cut through the helmet shell and engage a rim of the fastening hole, respectively; and wherein the knots are inserted into a narrowing fastening hole in the form of a cutout cut through the helmet shell and are hooked in the narrowing fastening hole of the helmet shell.

2. Fastening system according to claim 1, characterized in that the decorative or functional elements are positioned in a recess of the helmet shell.

3. Fastening system according to claim 1, characterized in that the ends of the decorative or functional elements are located in the fastened state underneath the helmet shell.

4. Fastening system according to claim 1, characterized in that the decorative or functional element is light-reflecting, phosphorescent or luminescent.

5. Fastening system according to claim 4, characterized in that the decorative or functional elements are an LED hose or electroluminescent.

6. Fastening system according to claim 5, characterized in that the decorative or functional elements have a battery compartment and an on/off switch in the area of the connecting element.

7. Fastening system according to claim 1, characterized in that the decorative or functional elements have a flag.

8. Fastening system according to claim 7, characterized in that between the two decorative or functional elements a flat element is arranged.

9. Hose-shaped or strip-shaped decorative or functional element for use with a fastening system according to claim 1, comprising a connecting element for connecting with a helmet shell, wherein the connecting element is selected from the group consisting of hooks and of knots of the decorative or functional element, wherein the hooks are connected fixedly to the decorative or functional element, wherein the hooks are configured to be hooked in a fastening hole in the form of a cutout cut through the helmet shell and configured to engage a rim of the fastening hole; and wherein the knots are configured to be inserted into a narrowing fastening hole in the form of a cutout cut through of the helmet shell and configured to be hooked in the narrowing fastening hole of the helmet shell.

10. Entity of two decorative or functional elements according to claim 9 and a flat element that is arranged between the decorative or functional elements and that is connected with the decorative or functional elements.

11. Entity according to claim 10, characterized in that the flat element is a film, a watertight textile material, or a net-like element.

12. Fastening system according to claim 1, characterized in that the hooks each comprise a ring and an extension extending away from the ring perpendicular to a plane of the ring, wherein the extension has a bent end opposite the ring, wherein the ring surrounds an end section of the decorative or functional element and is secured to the end section by compression, wherein the bent end of the extension is configured to engage the rim of the fastening hole of the helmet shell.

* * * * *